US005967756A

United States Patent [19]

Devier et al.

[11] Patent Number: 5,967,756

[45] Date of Patent: Oct. 19, 1999

[54] POWER MANAGEMENT CONTROL SYSTEM FOR A HYDRAULIC WORK MACHINE

[75] Inventors: Lonnie J. Devier, Dunlap; Stephen V. Lunzman, Chillicothe, both of Ill.

[73] Assignee: Caterpillar Inc., Peoria, Ill.

[21] Appl. No.: 08/886,727

[22] Filed: Jul. 1, 1997

[51] Int. Cl.[6] ..... F04B 49/00

[52] U.S. Cl. ..... 417/18; 417/34

[58] Field of Search ..... 417/18, 34, 53; 60/452

[56] References Cited

U.S. PATENT DOCUMENTS

| | | | |
|---|---|---|---|
| 563,017 | 5/1997 | Takamura et al. | 60/445 |
| 3,713,295 | 1/1973 | Haak et al. | 60/52 |
| 3,727,628 | 4/1973 | Habiger et al. | 137/101 |
| 3,963,378 | 6/1976 | McMillan | 417/216 |
| 4,395,199 | 7/1983 | Izumi et al. | 417/53 |
| 4,507,057 | 3/1985 | Igarashi et al. | 417/216 |
| 4,523,892 | 6/1985 | Mitchell et al. | 417/34 |
| 4,534,707 | 8/1985 | Mitchell | 417/34 |
| 4,637,781 | 1/1987 | Akiyama et al. | 417/216 |
| 4,697,418 | 10/1987 | Okabe et al. | 60/434 |
| 4,726,186 | 2/1988 | Tatsumi et al. | 60/434 |
| 4,809,504 | 3/1989 | Izumi et al. | 60/430 |
| 4,942,737 | 7/1990 | Tatsumi | 60/431 |
| 5,077,973 | 1/1992 | Suzuki et al. | 60/428 |
| 5,155,996 | 10/1992 | Tatsumi et al. | 60/431 |
| 5,226,800 | 7/1993 | Morino | 417/218 |
| 5,295,353 | 3/1994 | Ikari | 60/431 |
| 5,307,631 | 5/1994 | Tatsumi et al. | 60/452 |
| 5,468,126 | 11/1995 | Lukich | 417/53 |
| 5,469,646 | 11/1995 | Takamura | 37/382 |
| 5,481,875 | 1/1996 | Takamura et al. | 60/443 |
| 5,525,043 | 6/1996 | Lukich | 417/218 |

FOREIGN PATENT DOCUMENTS 0532756 10/1996 European Pat. Off. .

*Primary Examiner*—Charles G. Freay
*Assistant Examiner*—Robert Z. Evora
*Attorney, Agent, or Firm*—David M. Masterson; Kevin M. Kercher

[57] ABSTRACT

An apparatus for controlling an electrohydraulic system of a work machine having an engine that drives a variable displacement pump is disclosed. A pump displacement setting device produces a pump command signal indicative of a desired displacement of the variable displacement pump. An engine speed setting device produces an engine command signal indicative of a desired rotational speed of the engine. A power manager receives the pump and engine command signals, determines an efficient engine speed and pump displacement, and produces an engine control signal that decreases the engine speed to the efficient engine speed and a pump control signal that increases the pump displacement to an efficient pump displacement, while maintaining a substantially constant pump flow rate.

13 Claims, 2 Drawing Sheets

POWER MANAGEMENT CONTROL SYSTEM FOR A HYDRAULIC WORK MACHINE

TECHNICAL FIELD

This invention relates generally to a power management control system for a hydraulic work machine and, more particularly, to a power management control system for a hydraulic work machine that determines an optimal engine speed and pump displacement.

BACKGROUND ART

In the field of hydraulic work machines, for example, hydraulic excavators, variable displacement hydraulic pumps are typically driven by an engine to provide hydraulic power to a plurality of work elements which includes the drive system. Excavators, being extremely versatile machines, are useful in performing a large number of different and varied tasks, e.g., pipelaying, mass excavation, trenching, logging, etc., each task having its own unique hydraulic flow and pressure requirements. For example, during mass excavation, hydraulic power requirements are quite high with brief periods of reduced need, but in pipelaying, sustained periods of low power during waiting are common with sessions of moderate to high power.

Rudimentary control schemes have been utilized to control the engine speed of an excavator. For example, these control schemes have shown that the engine speed may be reduced to low idle during sustained periods of waiting to conserve fuel. However, these types of control schemes do not recognize controlling the engine speed during active times where less than maximum engine speed and pump flow would be required.

More sophisticated control schemes have shown that the engine speed and hydraulic pump displacement can be controlled in response to loads subjected on the work vehicle. For example, U.S. Pat. No. 4,523,892 issued to Mitchell et al. on Jun. 18, 1985, discloses an electronic control system for a hydraulic excavator which controls the engine speed and pump displacement. The control system reduces pump displacement in response to the operating speed of the engine lugging below a desired operating speed. Further, the control system reduces the engine speed in response to the operating speed of the engine rising above the desired operating speed. In this manner, the electronic control adjusts for engine lag but the electronic control does not correct the inefficiencies of the system. Thus, the electronic control improves, but does not minimize fuel consumption nor eliminate undesirable engine lag.

The present invention is directed to overcoming one or more of the problems as set forth above.

DISCLOSURE OF THE INVENTION

In one aspect of the present invention, an apparatus for controlling an electrohydraulic system of a work machine having an engine that drives a variable displacement pump is disclosed. A pump displacement setting device produces a pump command signal indicative of a desired displacement of the variable displacement pump. An engine speed setting device produces an engine command signal indicative of a desired rotational speed of the engine. A power manager receives the pump and engine command signals, determines an efficient engine speed and pump displacement, and produces an engine control signal that decreases the engine speed to the efficient engine speed and a pump control signal that increases the pump displacement to an efficient pump displacement, while maintaining a substantially constant pump flow rate.

BRIEF DESCRIPTION OF THE DRAWINGS

For a better understanding of the present invention, reference may be made to the accompanying drawings in which.

BEST MODE FOR CARRYING OUT THE INVENTION

Figure 1:
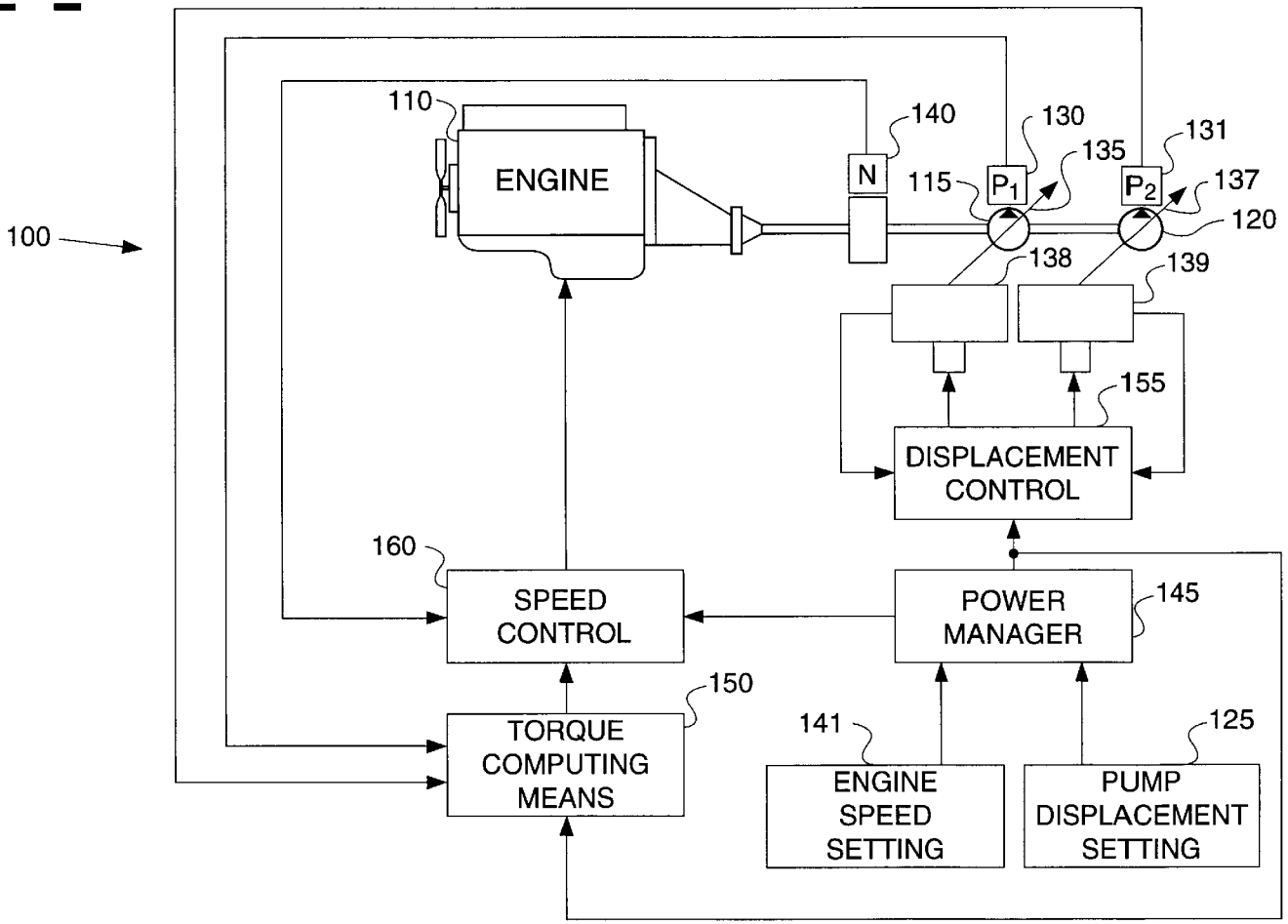
FIG. 1 illustrates a block diagram of an electrohydraulic control system for a work machine.

Reference is now made to FIG. 1 which illustrates a block diagram of an electrohydraulic control system 100 in accordance with the present invention. The electrohydraulic control system 100 is applicable to any hydrostatic controlled work machine, including an excavator. The control system 100 includes a power source such as an internal combustion engine 110, which drives one or more variable displacement pumps 115,120. The pumps 115,120 deliver fluid to a plurality of work elements (not shown). The work elements include hydraulic motors and cylinders for operating the excavator's work implement, housing, and tracks.

A pump displacement setting device 125, a.k.a., an operator control lever, produces a pump command signal indicative of a desired displacement of the variable displacement pump. The pump displacement setting device 125 preferably includes an electronic joystick. For example, the joystick produces an electronic signal having a magnitude that is indicative of a desired velocity of a work element. As is well known in the art, the electronic signal magnitude is processed via a look-up table to compute a desired pump displacement to achieve the desired velocity.

Pressure sensors 130,131 detect the fluid pressure associated with the variable displacement pumps and produce respective pressure signals indicative of the detected fluid pressure. The fluid pressure signal is additionally representative of the load on the engine. The pumps 115,120 include electronically controlled swashplates 135,137 for controlling the displacement of the pumps. The swashplates 135, 137 additionally include displacement sensors 138,139 that are adapted to detect the displacement of a respective variable displacement pump by sensing the swashplate position and produce a respective displacement signal indicative of the pump displacement.

An engine speed sensor 140 detects the speed of the engine and produce an engine speed signal indicative of the actual engine speed. An engine speed setting device 141 produces an engine speed command signal indicative of a desired speed of the engine. The engine speed setting device 141 preferably includes a rotary knob for "dialing-in" the desired engine speed.

Advantageously, a power manager 145 is provided to control the speed of the engine and the displacement of the pumps in order to produce hydraulic power efficiently. More particularly, the power manager 145 receives the pump and engine command signals, and produces an engine control signal that decreases the engine speed to an efficient engine speed and a pump control signal that increases the pump displacement to an efficient pump displacement. More particularly, the pump displacement is increased by an amount to maintain a substantially constant pump flow rate.

The engine speed control signal is delivered to an electronic speed control, a.k.a., engine governor, 160 that regulates the speed of the engine in accordance with the engine control signal. The pump control signal is delivered to an electronic displacement control 155 that controls the displacement of the pumps in accordance with the pump control signals.

Figure 2:
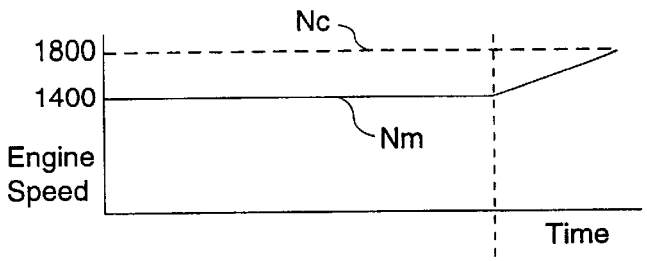
FIG. 2 illustrates a graphical illustration of engine speed versus time.

Reference is now made to the illustrations on page 2 of the FIGS. which show the effect of the power manager 145 on the engine speed and pump displacement. For example, FIG. 2 shows a graphical illustration of engine speed over time. The dashed line, noted by $N_c$, represents the engine speed that is associated with the engine speed command signal. For example, typically an operator of an excavator will "dial-in" a desired engine speed at a maximum RPM, shown here as 1800 RPM. Advantageously, the power manager 145 will decrease the engine RPM to a lower, predetermined level in order to promote fuel efficiency. Consequently, the power manager produces an engine control signal, represented here as $N_m$, that causes the engine to rotate at a lower, more efficient RPM, shown here as 1400 RPM.

Figure 3:
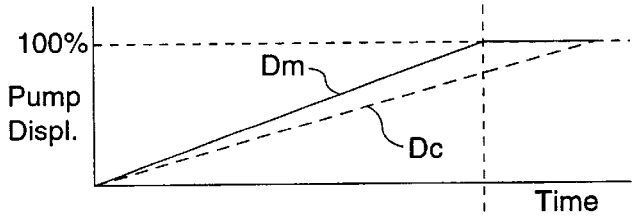
FIG. 3 illustrates a graphical illustration of pump displacement versus time.

Reference is now made to FIG. 3 which shows a graphical illustration of pump displacement over time. The pump displacement associated with the pump command signal is shown by the dashed line, $D_c$. Advantageously, the power manager 145 increases the pump displacement by an amount to achieve the same pump flow when the engine was operating at the maximum engine speed. Accordingly, the power manager 145 produces a pump control signal, represented here as $D_m$, that causes the pump displacement to increase at a rate proportional to the reduction in engine speed. In this example, the pump displacement is increased by a ratio of 18 to 14, i e., a ratio that equates the maximum engine speed to the lower, efficient engine speed.

As shown by the Figures, once the pump displacement is increased to 100%, the engine speed is then increased to increase the pump flow as requested by the machine operator vis-a-vis the pump command. For example, the effect to the electrohydraulic system of modifying the engine speed and pump displacement is shown in FIGS. 4 and 5.

Figure 4:
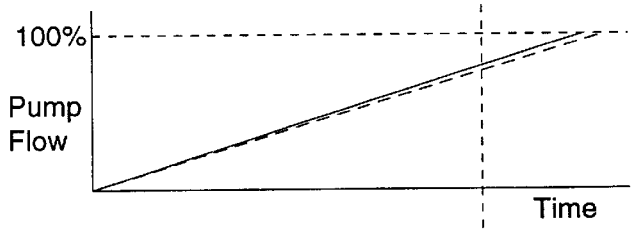
FIG. 4 illustrates a graphical illustration of pump flow versus time.

FIG. 4 illustrates the pump flow over time where the solid line represents the pump flow prior to the application of the power manager and the dashed line shows the effect of the pump flow after the application of the power manager. FIG. 4 shows that the pump flow is maintained at a substantially consistent rate.

Figure 5:
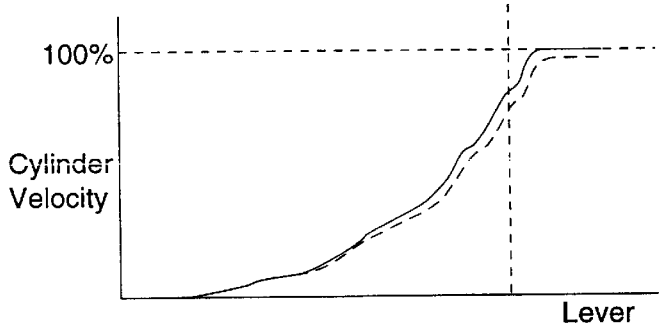
FIG. 5 illustrates a graphical illustration of hydraulic cylinder velocity versus control lever position.

FIG. 5 illustrates the velocity of a hydraulic cylinder corresponding to the control lever position where the solid line represents the cylinder velocity prior to the application of the power manager and the dashed line shows the cylinder velocity after the application of the power manager. FIG. 5 shows that the cylinder velocity is maintained at a substantially consistent rate.

Thus, the present invention provides for the engine to run at a lower, more fuel efficient speed, and the pumps to operate at a higher, more efficient displacement, while providing for the pump flow and cylinder velocity to remain unchanged.

Referring back to FIG. 1, a torque computing means 150 receives the pump pressure and displacement signals, responsively computes the torque on the engine and produces a torque signal indicative of the computed torque. Note, the torque computing means 150 can receive signals representing the actual pump displacement or the commanded pump displacement. The engine torque is computed in accordance with the following equation:

Engine Torque =Pump Displacement*Pump Pressure

The torque computing means 150 delivers a torque signal to the speed control 160, which computes a change in engine torque over time. If the engine torque is found to increase, then the speed control 160 increases the fuel rate to the engine based on the increase in engine load. In this way, the speed control 160 adjusts the engine fuel rate to prevent engine lug based on an increase in engine load.

Note, the power manager and torque computing means 145,150, as well as, the speed control 160, are microprocessor based systems which utilize arithmetic units for controlling various processes. The processes may be embodied in computer programs that are stored in read-only memory, random-access memory, or the like.

Thus, while the present invention has been particularly shown and described with reference to the preferred embodiment above, it will be understood by those skilled in the art that various additional embodiments may be contemplated without departing from the spirit and scope of the present invention.

Industrial Applicability

In operation, the present invention is adapted to control the hydro-mechanical system of a work machine, e.g., an excavator, to produce hydraulic power in an efficient manner. More specifically, the present invention reduces the engine speed from a maximum level to a predetermined level, while additionally increasing the pump displacement to provide for the same pump flow at the lower engine speed. Once maximum pump flow is required, then the present invention increases the engine speed to the maximum level.

While the present invention has been described primarily in association with the hydraulic system of excavators, it is recognized that the invention can be implemented on most any engine and hydraulic pump arrangements.

Other aspects, objects and advantages of the present invention can be obtained from a study of the drawings, the disclosure and the appended claims.

We claim:

1. An apparatus for controlling an electrohydraulic system of a work machine having an engine that drives a variable displacement pump, comprising:

a pump displacement setting device adapted to produce a pump command signal indicative of a desired displacement of the variable displacement pump;

an engine speed setting device adapted to produce an engine command signal indicative of a desired rotational speed of the engine;

a power manager adapted to receive the pump and engine command signals, determine an efficient engine speed and pump displacement, and produce an engine control signal that decreases the engine speed to the efficient engine speed and a pump control signal that increases the pump displacement to an efficient pump displacement.

2. An apparatus, as set forth in claim 1, wherein the power manager reduces the engine speed to a lower, predetermined level and increases the pump displacement to a higher level proportional to the decrease in engine speed, and when the pump displacement is increased to a maximum pump displacement the engine speed is increased to a maximum engine speed to provide for a maximum pump flow.

3. An apparatus, as set forth in claim 1, including a displacement sensor adapted to detect the displacement of the variable displacement pump and produce a displacement signal indicative of the pump displacement.

4. An apparatus, as set forth in claim 3, including a pressure sensor adapted to detect the fluid pressure associated with the variable displacement pump and produce a pressure signal indicative of the fluid pressure.

5. An apparatus, as set forth in claim 4, including a torque computing means for receiving the pump pressure and displacement signals, responsively computing the torque on the engine and producing a torque signal indicative of the computed torque.

6. An apparatus, as set forth in claim 5, including a speed control for receiving the engine speed control signal and regulating the speed of the engine in accordance with the engine control signal.

7. An apparatus, as set forth in claim 6, wherein the speed control receives the torque signal, computes a change in engine torque over time, and increases the engine fuel rate in response to an increase in engine torque.

8. A method for controlling an electrohydraulic system of a work machine having an engine that drives a variable displacement pump, comprising the steps of:

producing a pump command signal indicative of a desired displacement of the variable displacement pump;

producing an engine command signal indicative of a desired rotational speed of the engine;

determining an efficient engine speed and pump displacement in response to the desired engine speed and pump displacement and producing an engine control signal that decreases the engine speed to the efficient engine speed and a pump control signal that increases the pump displacement to an efficient pump displacement.

9. A method, as set forth in claim 8, including the steps of reducing the engine speed to a lower, predetermined level and increasing the pump displacement to a higher level proportional to the decrease in engine speed, and when the pump displacement is increased to a maximum pump displacement the engine speed is increased to a maximum engine speed to provide for a maximum pump flow.

10. A method, as set forth in claim 9, including the steps of sensing the fluid pressure associated with the variable displacement pump and producing a pressure signal indicative of the fluid pressure.

11. A method, as set forth in claim 10, including the steps of computing the torque on the engine based on the pump pressure and pump displacement, and producing a torque signal indicative of the computed torque.

12. A method, as set forth in claim 11, including the steps of receiving the engine speed control signal and regulating the speed of the engine in accordance with the engine control signal.

13. A method, as set forth in claim 12, including the steps of receiving the torque signal, computing a change in engine torque over time, and increasing the engine fuel rate in response to an increase in engine torque.

* * * * *